US010921742B2

(12) United States Patent
Nishimura

(10) Patent No.: US 10,921,742 B2
(45) Date of Patent: Feb. 16, 2021

(54) IMAGE FORMING APPARATUS PERFORMING GENUINE PRODUCT DETERMINATION FOR CONSUMABLE UNIT

(71) Applicant: KYOCERA Document Solutions Inc., Osaka (JP)

(72) Inventor: Jun Nishimura, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 16/746,388

(22) Filed: Jan. 17, 2020

(65) Prior Publication Data

US 2020/0233359 A1 Jul. 23, 2020

(30) Foreign Application Priority Data

Jan. 22, 2019 (JP) ..... JP2019-008709

(51) Int. Cl.
*G03G 15/00* (2006.01)

(52) U.S. Cl.
CPC ..... *G03G 15/5091* (2013.01)

(58) Field of Classification Search
None
See application file for complete search history.

(56) References Cited

U.S. PATENT DOCUMENTS

2003/0231361 A1* 12/2003 Kato ..... H04N 1/00055 358/501
2016/0037003 A1* 2/2016 Oku ..... H04N 1/00832 358/406

FOREIGN PATENT DOCUMENTS

JP 2013-101437 5/2013

* cited by examiner

*Primary Examiner* — Victor Verbitsky

(57) ABSTRACT

In a server authentication process, a controller (a) transmits identification information of a consumable unit to an authentication server, and causes the authentication server to determine whether the consumable unit is a genuine product or not on the basis of the identification information and (b) receives the genuine product determination result from the authentication server. Further, (a) upon detecting replacement of the consumable unit, the controller reads identification information from a storage device of the consumable unit, performs the server authentication process based on the read identification information, and stores the received genuine product determination result into the non-volatile storage device, and (b) when powered on, the controller determines whether the consumable unit currently mounted is a genuine product or not on the basis of the genuine product determination result stored in the non-volatile storage device, without performing the server authentication process.

3 Claims, 4 Drawing Sheets

FIG. 2

| ADDRESS | DATA | INITIAL VALUE |
|---|---|---|
| 074D | IDENTIFICATION INFORMATION OF TONER CONTAINER (ID) | 58 |
| 074E | | 58 |
| 074F | | 58 |
| 0750 | | 58 |
| 0751 | | 58 |
| 0752 | | 58 |
| 0753 | | 58 |
| 0754 | | 58 |
| 0755 | | 58 |
| 0756 | | 58 |
| 0757 | GENUINE PRODUCT DETERMINATION RESULT | 58 |

IMAGE FORMING APPARATUS PERFORMING GENUINE PRODUCT DETERMINATION FOR CONSUMABLE UNIT

CROSS-REFERENCE TO RELATED APPLICATIONS

This application relates to and claims priority rights from Japanese Patent Application No. 2019-008709, filed on Jan. 22, 2019, the entire disclosures of which are hereby incorporated by reference herein.

BACKGROUND

1. Field of the Present Disclosure

The present disclosure relates to an image forming apparatus.

2. Description of the Related Art

In a system, an information processing apparatus watches plural image forming apparatuses. Every time powered on, the image forming apparatus reads consumable article information from a memory mounted to a removable toner container and transmits the information to the information processing apparatus. Upon receiving the consumable article information from the image forming apparatus, the information processing apparatus determines whether the toner container is a genuine product or not on the basis of the consumable article information.

However in a case as mentioned, that every time powered on, consumable article information is read from a memory of a toner container and it is determined whether the toner container is a genuine product or not on the basis of the consumable article information, long starting time is required when the image forming apparatus is powered on. In particular, it causes inconvenience to a user who uses only genuine toner containers.

SUMMARY

An image forming apparatus according to an aspect of the present disclosure includes a printing device to which a consumable unit is mounted, a communication device, a controller, and a non-volatile storage device. The printing device is configured to perform printing using the consumable unit. The communication device is configured to communicate with an authentication server that determines whether the consumable unit is a genuine product or not on the basis of identification information of the consumable unit. The controller is configured to read identification information of the consumable unit from a storage device mounted to the consumable unit and perform a server authentication process based on the identification information. In the server authentication process, the controller (a) transmits the read identification information to the authentication server using the communication device, and causes the authentication server to determine whether the consumable unit is a genuine product or not on the basis of the transmitted identification information and transmit the genuine product determination result, and (b) receives the genuine product determination result from the authentication server using the communication device. Further, (a) upon detecting replacement of the consumable unit, the controller reads identification information from a storage device of the consumable unit, performs the server authentication process based on the read identification information, and stores the received genuine product determination result into the non-volatile storage device, and (b) when powered on, the controller determines whether the consumable unit currently mounted is a genuine product or not on the basis of the genuine product determination result stored in the non-volatile storage device, without performing the server authentication process.

These and other objects, features and advantages of the present disclosure will become more apparent upon reading of the following detailed description along with the accompanied drawings.

BRIEF DESCRIPTION OF THE DRAWINGS

FIG. 2 shows a diagram that indicates an example of a memory map of a non-volatile storage device 13*a* in the image forming apparatus 1 shown in FIG. 1;

DETAILED DESCRIPTION

Hereinafter, an embodiment according to an aspect of the present disclosure will be explained with reference to drawings.

Figure 1:
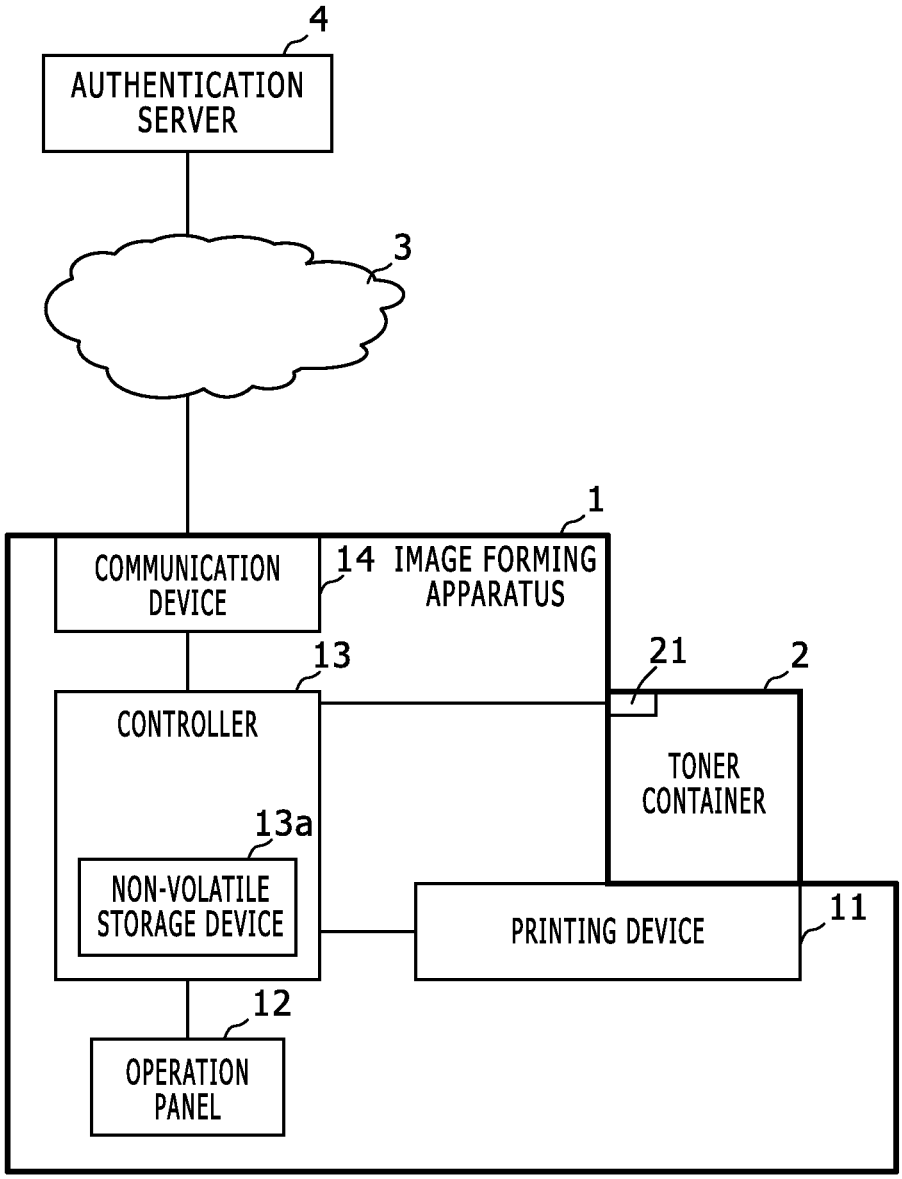
FIG. 1 shows a block diagram that indicates a configuration of an image forming apparatus according to an embodiment of the present disclosure.

FIG. 1 shows a block diagram that indicates a configuration of an image forming apparatus according to an embodiment of the present disclosure. The image forming system shown in FIG. 1 includes an image forming apparatus 1, for example, of an electrophotographic method, and a toner container 2 enabled to be mounted to the image forming apparatus 1.

The image forming apparatus 1 is a printer, a multi function peripheral or the like, and includes a printing device 11, an operation panel 12, a controller 13, and a communication device 14.

The printing device 11 includes a photoconductor drum, an exposure device, a development device, an intermediate transfer belt, a fuser and the like (not shown). The exposure device forms an electrostatic latent image on the photoconductor drum, and the development device forms a toner image by attaching toner to the electrostatic latent image. After transferring the toner image onto a printing paper sheet, the fuser fixes the toner image on the printing paper sheet and outputs the printing paper sheet.

In the toner container 2, an inside toner storage part is filled with toner. The toner container 2 is mounted to the printing device 11 of the image forming apparatus 1, and the printing device 11 uses the toner in the toner container and thereby forms a toner image and performs printing. Therefore, when the toner in the toner container 2 is exhausted, the toner container 2 is replaced with a toner container 2 filled with toner. Thus, the toner container 2 is enabled to be mounted and demounted to and from the image forming apparatus 1.

Sorts of consumable units such as the toner container 2, a photoconductor drum unit, and an intermediate transfer belt unit are mounted to the printing device 11, and the printing device 11 performs printing using these consumable units. For each of the consumable units, a genuine product determination process mentioned below is performed.

The operation panel 12 includes a display device that displays sorts of information to a user and an input device that receives a user operation. For example, the display device includes a liquid crystal display, an indicator and/or the like. Further, for example, the input device includes a touch panel, a hard key and/or the like.

The controller 13 includes a micro computer, an ASIC (Application Specific Integrated Circuit), and/or the like and performs sorts of processes. For example, the controller 13 displays an operation screen on the display device of the operation panel 12, displays sorts of messages to a user on the display device, and controls the printing device 11 in accordance with a user operation performed to the input device of the operation panel 12 and thereby causes the printing device 11 to perform printing.

The communication device 14 is a network interface or the like, for example, capable of connecting to the network 3, and communicates with an authentication server 4. The authentication server 4 is, for example, connected to the network 3, and includes a database (not shown) of identification information that has been assigned to a toner container manufactured by a legitimate manufacturer (i.e. a genuine product). The authentication server 4 receives identification information of a consumable unit such as the toner container 2 from one or plural image forming apparatuses 1, determines whether the consumable unit is a genuine product or not on the basis of the received identification information, and transmits the genuine product determination result to the image forming apparatus 1. For example, the genuine product determination result is expressed as a binary value (e.g. 0 or 1) that indicates a genuine product or a non-genuine product.

Hereinafter, an example is explained under an assumption that the consumable unit is the toner container 2. The same manner can be applied for the other consumable units.

The controller 13 reads consumable unit identification information from the storage device 21 mounted to the toner container 2, and performs the server authentication process based on the read identification information. For example, this identification information (ID) is a unique code to the toner container 2, and is set so as to hardly be illicitly generated. The storage device 21 is, for example, an IC (Integrated Circuit) chip that includes a memory such as ROM (Read Only Memory).

In the server authentication process, the controller (a) transmits the identification information read from the toner container 2 to the authentication server 4 using the communication device 14. The authentication server 4 determines whether the toner container 2 is a genuine product or not on the basis of the identification information received from the controller 13, and transmits the genuine product determination result to the controller 13. The controller 13 (b) receives the genuine product determination result from the authentication server 4 through the communication device 14.

For example, if the genuine product determination result is not received when time out or the like occurs due to communication failure, then the genuine product determination result is considered as non-genuine product.

(a) Upon detecting replacement of the toner container 2, the controller 13 reads the identification information from the storage device 21 of the toner container 2, and performs the server authentication process based on the read identification information. The controller 13 stores the received genuine product determination result into the non-volatile storage device 13*a*, and (b) performs a genuine product determination process when powered on. In the genuine product determination process, the server authentication process is not performed, and it is determined whether the toner container 2 currently mounted is a genuine product or not on the basis of the genuine product determination result stored in the non-volatile storage device 13*a*.

The non-volatile storage device 13*a* is an EEPROM (Electrically Erasable Programmable Read-Only Memory) or the like, and may be built in the controller 13 or may be an external memory connected to the controller 13.

FIG. 2 shows a diagram that indicates an example of a memory map of the non-volatile storage device 13*a* in the image forming apparatus 1 shown in FIG. 1. As shown in FIG. 2, in the non-volatile storage device 13*a*, when replacement of the toner container 2 is detected, memory areas are continuously allocated for the identification information (ID) read from the toner contained currently mounted and the genuine product determination result for this toner container 2. In the aforementioned manner, the genuine product determination result is stored in such memory area so as to be associated with the identification information.

Further, in this embodiment, when the non-volatile storage device 13*a* is out of order and the genuine product determination result can not be read out, the controller 13 performs the server authentication process, and determines whether the consumable unit currently mounted is a genuine product or not on the basis of the received genuine product determination result.

If the controller 13 determines that the consumable unit currently mounted is a non-genuine product on the basis of the genuine product determination result stored in the non-volatile storage device 13*a*, then the controller 13 may perform the server authentication process, and renew the genuine product determination result stored in the non-volatile storage device 13*a* with the received genuine product determination result.

The following part explains a behavior of the aforementioned image forming apparatus.

(a) When the Toner Container is Replaced in a Power-on Status.

Figure 3:
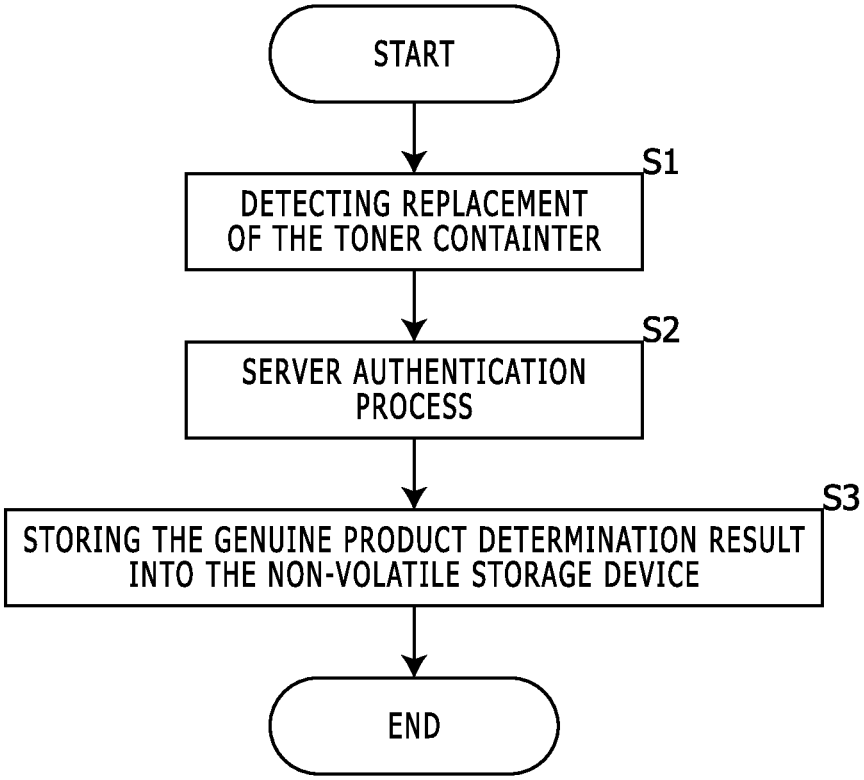
FIG. 3 shows a flowchart that explains a behavior of the image forming apparatus 1 shown in FIG. 1 when a toner container 2 is replaced in a power-on status.

FIG. 3 shows a flowchart that explains a behavior of the image forming apparatus 1 shown in FIG. 1 when a toner container 2 is replaced in a power-on status.

Replacement of the toner container 2 is detected, for example, by detecting mounting and demounting the toner container 2 using a sensor (not shown), or determining whether identification information of the toner container 2 agrees with the identification information stored in the non-volatile storage device 13*a* or not.

Upon detecting replacement of the toner container 2 in the aforementioned manner (in Step S1), the controller 13 immediately performs the server authentication process, receives the genuine product determination result from the authentication server 4 (in Step S2), and stores the received genuine product determination result into the non-volatile storage device 13*a* (in Step S3).

(b) When the Toner Container is Replaced in a Power-Off Status.

Figure 4:
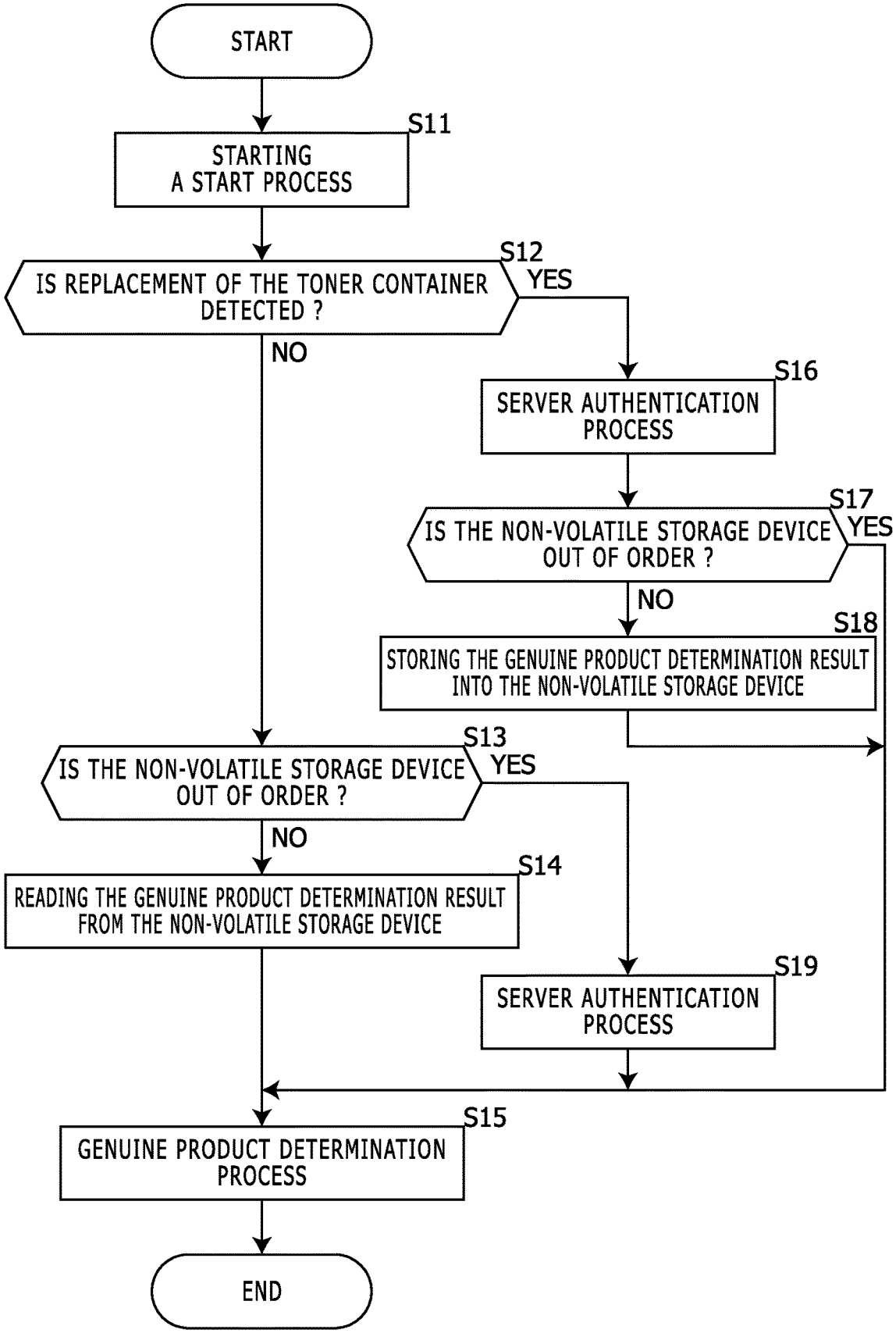
FIG. 4 shows a flowchart that explains a genuine product determination process in the image forming apparatus shown in FIG. 1.

If the toner container 2 is replaced in a power-off status, the replacement of the toner container 2 is detected when firstly powered on afterward, as mentioned below (FIG. 4).

(c) Genuine Product Determination Process when Powered on.

FIG. 4 shows a flowchart that explains a genuine product determination process in the image forming apparatus 1 shown in FIG. 1.

When the image forming apparatus 1 is powered on, the controller 13 starts a predetermined starting process (in Step S11), and determines whether replacement of the toner container 2 is detected or not (in Step S12).

If replacement of the toner container 2 is not detected, then the controller 13 reads the genuine product determination result of the toner container 2 from the non-volatile storage device 13*a*, if the non-volatile storage device 13*a* is not out of order (in Steps S13 and S14). Subsequently, the genuine product determination process is performed on the basis of a value of the read genuine product determination result (in Step S15).

Contrarily, if replacement of the toner container 2 is detected, then the controller 13 performs the server authentication process and receives the genuine product determination result from the authentication server 4 (in Step S16). If the non-volatile storage device 13*a* is not out of order (in Step S17), the controller 13 stores the received genuine product determination result into the non-volatile storage device 13*a* (in Step S18). Afterward, the controller 13 performs the genuine product determination process on the basis of a value of the received genuine product determination result (in Step S15).

Further, if replacement of the toner container 2 is not detected and the non-volatile storage device 13*a* is out of order (in Step S13), the controller 13 performs the server authentication process and receives the genuine product determination result from the authentication server (in Step S19), and performs the genuine product determination process on the basis of a value of the received genuine product determination result (in Step S15).

As mentioned, in the aforementioned embodiment, the toner container 2 is mounted to the printing device 11, and the printing device 11 performs printing using the toner container 2. The communication device 14 communicates with the authentication server 4 that determines whether the toner container 2 is a genuine product or not on the basis of identification information of the toner container 2. The controller 13 reads identification information of the toner container 2 from the storage device 21 mounted to the toner container 2, and performs the server authentication process based on the identification information. In the server authentication process, the controller 13 (*a*) transmits the read identification information to the authentication server using the communication device 14, and cause the authentication server 4 to determine whether the toner container 2 is a genuine product or not on the basis of the transmitted identification information and transmit the genuine product determination result. Subsequently, (b) the genuine product determination result is received from the authentication server 4 using the communication device 14. Subsequently, (a) upon detecting replacement of the toner container 2, the controller 13 reads identification information from the storage device 21 of the toner container 2, and performs the server authentication process based on the read identification information. The controller 13 stores the received genuine product determination result into the non-volatile storage device 13*a*. (b) When powered on, it is determined whether the toner container 2 currently mounted is a genuine product or not on the basis of the genuine product determination result stored in the non-volatile storage device 13*a*, without performing the server authentication process.

Consequently, genuine product determination of the toner container 2 is performed in a short time when powered on.

Further, even if the non-volatile storage device is out of order, the server authentication process is performed, and therefore, it is properly determined that the genuine consumable unit is a genuine product, without determining that the genuine consumable unit is a non-genuine product.

For example, the genuine product determination result is displayed on the operation panel 12 to notify a user or an administrator. Further, a parameter in a printing process of the printing device 11 may be adjusted on the basis of the genuine product determination result.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, if the image forming apparatus 1 is a color image forming apparatus that uses toner containers for plural colors, for each of the toner containers for plural colors, the controller 13 performs the server authentication process, stores the genuine product determination result into the non-volatile storage device 13*a*, and performs the genuine product determination process when powered on. In such a case, if a set of the toner containers for plural colors is used as the consumable unit, common identification information as the aforementioned identification information may be assigned to the set of the toner containers for plural colors; and the controller 13 may (a) store into the non-volatile storage device 13*a* the genuine product determination result received in the server authentication process for one toner container in the set of the toner containers for plural colors, and (b) read the genuine product determination result of this one toner container from the non-volatile storage device 13*a* and store the genuine product determination result of this one toner container as the genuine product determination results of the other toner containers into the non-volatile storage device 13*a*. Consequently, the number of times of the server authentication process is reduced, and the genuine product determination result is acquired in a short time for the aforementioned other toner containers.

What is claimed is:

1. An image forming apparatus, comprising:

a printing device to which a consumable unit is mounted, the printing device configured to perform printing using the consumable unit;

a communication device configured to communicate with an authentication server that determines whether the consumable unit is a genuine product or not on the basis of identification information of the consumable unit;

a controller configured to read identification information of the consumable unit from a storage device mounted to the consumable unit and perform a server authentication process based on the identification information; and a non-volatile storage device;

wherein in the server authentication process, the controller (a) transmits the read identification information to the authentication server using the communication device, and causes the authentication server to determine whether the consumable unit is a genuine product or not on the basis of the transmitted identification information and transmit the genuine product determination result, and (b) receives the genuine product determination result from the authentication server using the communication device; and (a) upon detecting replacement of the consumable unit, the controller reads identification information from a storage device of the consumable unit, performs the server authentication process based on the read identification information, and stores the received genuine product determination result into the non-volatile storage device, and (b) when powered on, the controller determines whether the consumable unit currently mounted is a genuine product or not on the basis of the genuine product determination result stored in the non-volatile storage device, without performing the server authentication process;

wherein the image forming apparatus is a color image forming apparatus that uses toner containers for plural colors;

the controller stores into the non-volatile storage device the respective genuine product determination results of the toner containers for plural colors;

the consumable unit is a set of the toner containers for plural colors;

the identification information is commonly assigned to the set of the toner containers for plural colors; and the controller (a) stores into the non-volatile storage device the genuine product determination result received in the server authentication process for one toner container in the set of the toner containers for plural colors, and (b) reads the genuine product determination result of this one toner container from the non-volatile storage device and stores the genuine product determination result of this one toner container as the genuine product determination results of the other toner containers into the non-volatile storage device.

2. The image forming apparatus according to claim 1, wherein if the controller determines that the consumable unit currently mounted is a non-genuine product on the basis of the genuine product determination result stored in the non-volatile storage device, then the controller performs the server authentication process, and renews the genuine product determination result stored in the non-volatile storage device with the received genuine product determination result.

3. The image forming apparatus according to claim 1, wherein when the non-volatile storage device is out of order and the genuine product determination result can not be read out, the controller performs the server authentication process, and determines whether the consumable unit currently mounted is a genuine product or not on the basis of the received genuine product determination result.

* * * * *